US006820558B2

(12) United States Patent
Haak et al.

(10) Patent No.: US 6,820,558 B2
(45) Date of Patent: Nov. 23, 2004

(54) DISK-SHAPED PROPELLANT MODULE

(75) Inventors: Hans-Karl Haak, Unterlüss (DE); Alexei Voronov, Grosskrotzenburg (DE)

(73) Assignee: Rheinmetall W & M GmbH, Unterluss (DE)

( * ) Notice: Subject to any disclaimer, the term of this patent is extended or adjusted under 35 U.S.C. 154(b) by 122 days.

(21) Appl. No.: 10/183,023

(22) Filed: Jun. 27, 2002

(65) Prior Publication Data

US 2003/0000412 A1 Jan. 2, 2003

(30) Foreign Application Priority Data

Jun. 27, 2001 (DE) ..... 101 30 970

(51) Int. Cl.[7] ..... C06D 5/06; C06B 45/00

(52) U.S. Cl. ..... 102/283; 102/284; 102/285; 102/291

(58) Field of Search ..... 102/283, 284, 102/285, 291, 443, 430

(56) References Cited

U.S. PATENT DOCUMENTS 3,811,380 A 5/1974 Glass
4,386,569 A * 6/1983 Deas ..... 102/292
4,408,534 A * 10/1983 Araki et al. ..... 102/288
5,101,730 A 4/1992 Bender et al.
5,251,549 A * 10/1993 Boisseau et al. ..... 102/289

FOREIGN PATENT DOCUMENTS

| | | | |
|---|---|---|---|
| DE | 42 02 129 | A1 | 7/1993 |
| EP | 0 822 384 | A2 | 2/1998 |
| FR | 2 625 306 | A1 | 6/1989 |
| WO | 94/25414 | A1 | 11/1994 |

* cited by examiner

*Primary Examiner*—Michael J. Carone
*Assistant Examiner*—Aileen B. Felton
(74) *Attorney, Agent, or Firm*—Venable LLP; Michael A. Sartori; Stuart I. Smith

(57) ABSTRACT

A disk-shaped propellant module (6) for a propellant charge (2), which can be composed of several modules of this type. To ensure a uniform and symmetrical ignition of the propellant charge (2) for a cartridge with increased charge density (>1.2 g/cm$^3$), the propellant module (6) is provided with at least three axially extending ignition channels (9), uniformly distributed over a partial circle, and at least three radial ignition channels (10) that extend from the inside or interior of the propellant module (6) to its outer edge surface (11). The center of the circle for the axial ignition channels (9) is positioned on the central axis (100) for the propellant module (6) and each of the radial ignition channels (10) intersects with at least one of the axial ignition channels (9).

7 Claims, 2 Drawing Sheets

DISK-SHAPED PROPELLANT MODULE

CROSS-REFERENCE TO RELATED APPLICATION

This application claims the priority of German Patent Application No. 101 30 970.8 filed Jun. 27, 2001, which is incorporated herein by reference.

BACKGROUND OF THE INVENTION

The invention relates to a disk-shaped propellant module for a propellant charge, which can be composed of several such modules.

An increase in the efficiency of large-caliber tank cannons, as a rule, requires an increase in the charge density of the propellant powder. However, a homogeneous ignition of the complete charge becomes more and more problematic with an increase in the charge density because the clearances provided in the charge for the propagation of flames or hot plasmas are too small. A non-homogeneous ignition on the other hand can lead to the formation of asymmetrical pressure waves in the powder chamber, which can destroy the weapon.

A ring-shaped tablet for gas generators is disclosed in German published patent application number DE 39 23 046 A1 and is used in particular for airbag generators. In order to increase the optimum conversion speed, the respective tablet has a central axial ignition channel, from which radial ignition channels, arranged on the top and underside of the tablet, extend toward the tablet edge.

SUMMARY OF THE INVENTION

It is the object of the present invention to provide a propellant module of the aforementioned type, which ensures a uniform and symmetrical ignition of the propellant charge of a cartridge with increased charge density (>1.2 g/cm$^3$).

The above object generally is achieved according to the invention by a disk-shaped propellant module for a propellant charge composed of several such modules, wherein the propellant module has at least three axially extending ignition channels that are uniformly distributed along a circle, and at least three radially extending ignition channels that extend from the inside or interior of the propellant module to the outer edge surface of the module, with the center of the circle on which the axial ignition channels are positioned is located on the central axis of the propellant module, and with each of the radially extending ignition channels intersecting with at least one of the axially extending ignition channels. Additional and particularly advantageous embodiments of the invention are disclosed in the dependent claims.

The essential idea behind the invention is to provide the propellant module with at least three, preferably six, axial ignition channels that are distributed uniformly along a circle, as well as at least three, preferably also six, radial ignition channels that extend from the interior, e.g., the center, of the propellant module to its outer surface. Each of the radial ignition channels in this case intersects at least one of the axial ignition channels. The central axis of the propellant module preferably forms the center of the circle on which the axial ignition channels are positioned.

In order to obtain a through ignition of the complete propellant charge, the individual propellant modules should be stacked inside the respective cartridge in such a way that their axial ignition channels together form one continuous ignition channel. The radial ignition channels ensure a better propagation of the flames or plasmas (in case of a plasma ignition) over the complete powder chamber. In addition, the radial ignition channels if possible should represent predetermined breakage points for the propellant powder disks. These predetermined breakage points allow an uninterrupted passage of the propellant charge in the area of transition from powder chamber to weapon tube since the radial ignition channels make it possible to achieve a defined structure of the respective propellant powder fragments.

It has proven advantageous if the separate propellant modules have a grooved chamfered surface, thus leaving a small clearance space between neighboring modules of the finished propellant for the lateral propagation of the flames over the complete powder chamber.

The use of multi-perforated propellant powder disks has proven useful to increase the progressiveness of the combustion, wherein the number of perforations should be between approximately 1000 and approximately 4000, depending on the desired progressiveness or wall thickness of the propellant module. The perforations can be inserted during the propellant powder extrusion or in the form of bores in a CNC-machine.

Further details and advantages of the invention follow from the exemplary embodiments below, which are explained with the aid of Figures.

DESCRIPTION OF THE PREFERRED EMBODIMENTS

Figure 1:
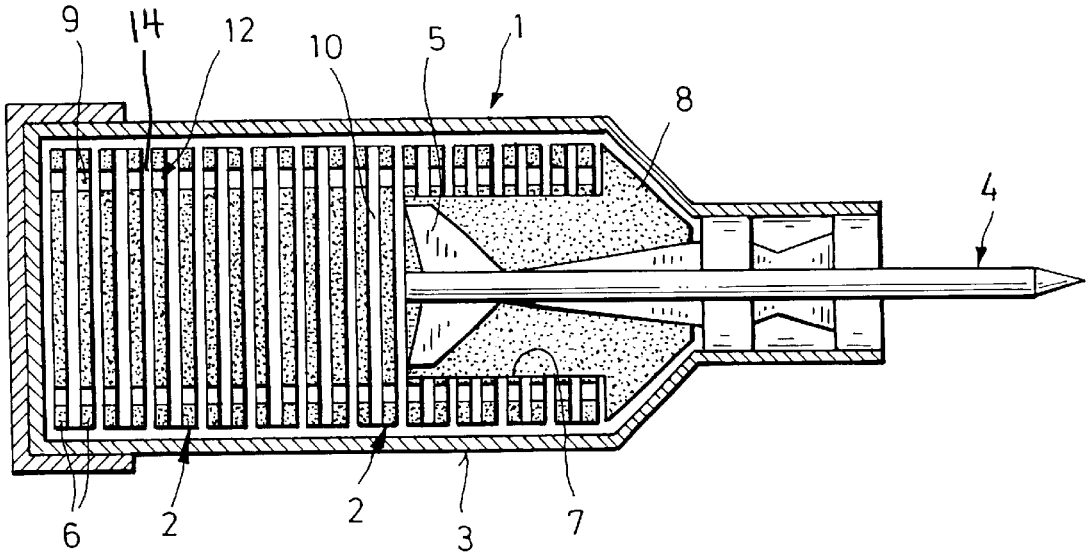
FIG. 1 is a longitudinal sectional view through a schematically shown cartridge with a discarding or propelling sabot projectile and a propellant charge consisting of propellant modules according to the invention.

FIG. 1 shows a cartridge 1 that comprises a propellant case 3 filled with a propellant charge 2 and a discarding sabot projectile 4, with the projectile tail 5 extending into the propellant case 3. The propellant charge 2 is essentially composed of a plurality of side-by-side stacked, disk-shaped propellant modules 6. In the region of the projectile tail 5, the propellant modules 6 are each provided with a central recess 7, into which loose bulk powder 8 is additionally inserted.

Figure 2:
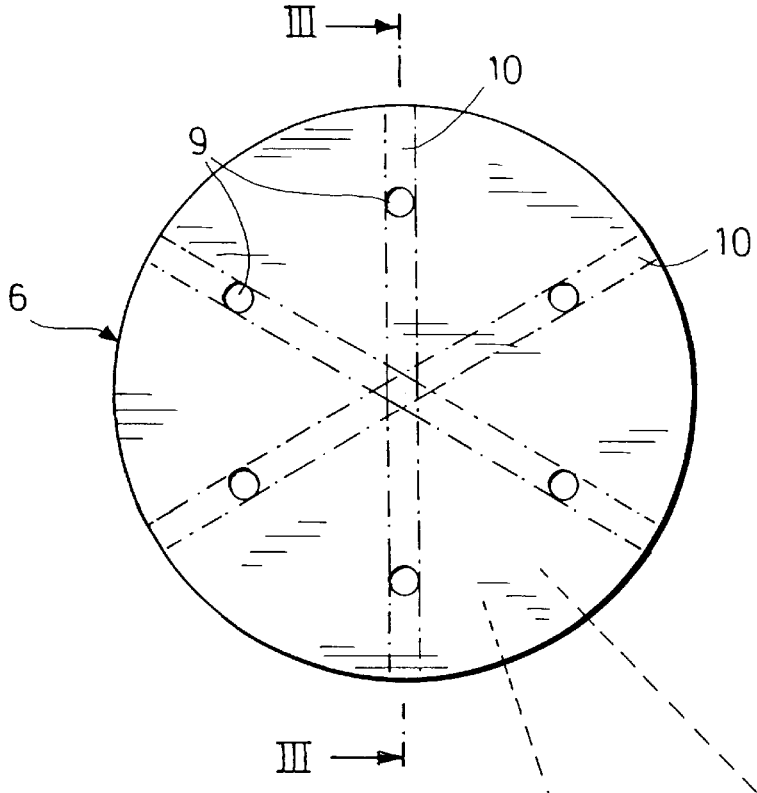
FIG. 2 is a view from above of an enlarged propellant module according to the invention.
Figure 3:
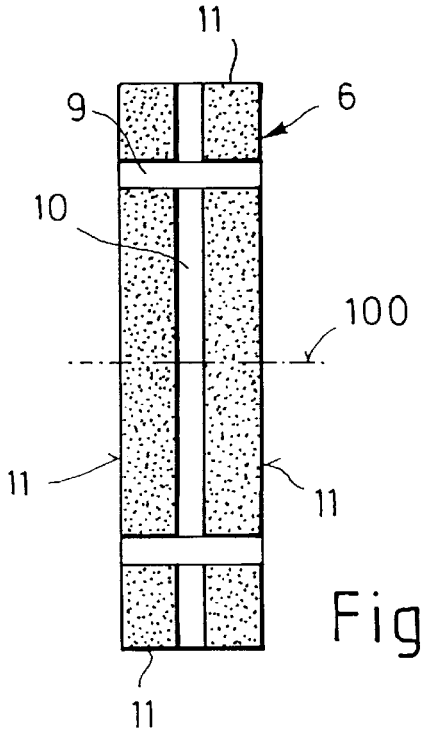
FIG. 3 is a cross sectional view through the propellant module shown in FIG. 2, along the sectional line III—III.

The individual propellant modules 6 are adapted, for example, to the propellant case 3 and have an outside diameter of approximately 150 mm, as well as a width or thickness of 5 to 20 mm. The individual modules 6 preferably are provided with six axial ignition channels 9 (FIG. 2) that are evenly distributed along a circle that is symmetrical to the central axis 100 of the propellant module 6. The modules also have a plurality of radial ignition channels 10 (FIG. 3), that are located on the inside of the propellant module 6 and extend from the interior to the outer surface edge 11' of the respective propellant module 6. At least three, and preferably six as shown, such radial ignition channels 10 are provided. Each radial ignition channel 10 intersects with at least one axial ignition channel 9. In the preferred illustrated embodiment, the six radial channels 10 form three continuous channels along three diameters so that each radially extending ignition channel 10, in effect, intersects with two axial ignition channels 9. The propellant modules 6 are stacked inside the propellant case 3 such that the axial ignition channels 9 of the plurality of modules 6 are aligned, and together form a continuous ignition channel 12 (FIG. 1).

The radial ignition channels 10 serve to improve the flame-front expansion and provide a better ignition of the propellant powder disks 6 from the inside, as well as to create predetermined breaking points for creating defined fragments, which permit a dust-free passage from the loading chamber of the respective weapon to the weapon tube.

The outer major surface 11 of the propellant module 6 is lightly grooved, so that a gap-like space 14 remains between neighboring propellant modules 6. Following the ignition of a propellant charge 2, this space permits a lateral expansion of the flames coming from the igniter, which is not shown herein.

Figure 4:
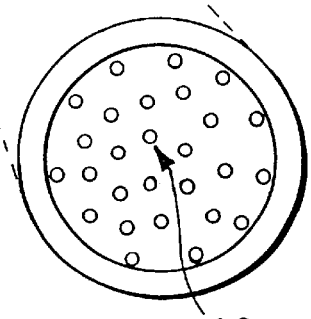
FIG. 4 is a greatly enlarged view through a magnifying lens of the surface for the propellant module shown in FIG. 2.

In order to increase the progressiveness of the propellant charge 2, the individual propellant modules 6 are multi-perforated powder disks, for example containing 3000 perforations 13 (FIG. 4) in each propellant module 6.

The invention now being fully described, it will be apparent to one of ordinary skill in the art that many changes and modifications can be made thereto without departing from the spirit or scope of the invention as set forth herein.

What is claimed is:

1. A disk-shaped propellant module for a propellant charge composed of several such modules, comprising: a disc-shaped propellant module having at least three axially extending ignition channels that are uniformly distributed along a circle, and at least three radially extending ignition channels that extend from the inside of the propellant module to an outer edge surface; and wherein the center of the circle on which the axial ignition channels are positioned is located on a central axis of the propellant module, and each of the radially extending ignition channels intersects with at least one of the axial ignition channels.

2. A propellant module according to claim 1, wherein the propellant module contains six axially extending ignition channels and six radially extending ignition channels.

3. A propellant module according to claim 2, wherein the propellant module has a grooved surface.

4. A propellant module according to claim 1, wherein the propellant module has a grooved surface.

5. A propellant module according to claim 1, wherein the propellant module is a multi-perforated propellant powder disk.

6. A propellant module according to claim 5, wherein the powder disk contains between 1000 and 4000 perforations.

7. A propellant charge including a plurality of disk-shaped propellant modules as defined in claim 1 disposed in a propellant case with the axially extending channels of adjacent modules being axially aligned.

* * * * *